US009236716B2

(12) United States Patent
Mizutani et al.

(10) Patent No.: US 9,236,716 B2
(45) Date of Patent: Jan. 12, 2016

(54) SPARK PLUG

(71) Applicant: NGK Spark Plug Co., Ltd., Nagoya-shi, Aichi (JP)

(72) Inventors: Hironobu Mizutani, Aichi (JP); Kei Takahashi, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/552,855

(22) Filed: Nov. 25, 2014

(65) Prior Publication Data

US 2015/0145403 A1 May 28, 2015

(30) Foreign Application Priority Data

Nov. 26, 2013 (JP) ..... 2013-243666
Oct. 20, 2014 (JP) ..... 2014-213799

(51) Int. Cl.
*H01T 13/20* (2006.01)
*H01T 13/32* (2006.01)
*H01T 13/52* (2006.01)

(52) U.S. Cl.
CPC ..... *H01T 13/32* (2013.01); *H01T 13/20* (2013.01); *H01T 13/52* (2013.01)

(58) Field of Classification Search
CPC ..... H01T 13/20; H01T 13/32; H01T 21/02; H01T 13/39; H01T 31/02; H01T 13/28
USPC ..... 313/118, 135, 137, 141–145
See application file for complete search history.

(56) References Cited

U.S. PATENT DOCUMENTS

| | | | | |
|---|---|---|---|---|
| 5,430,346 | A | 7/1995 | Johnson | 313/139 |
| 6,064,144 | A | 5/2000 | Knoll et al. | 313/141 |
| 6,307,307 | B1 * | 10/2001 | Kanao | 313/142 |
| 8,237,341 | B2 * | 8/2012 | Freeman et al. | 313/141 |
| 2002/0063504 | A1 * | 5/2002 | Hori | 313/141 |
| 2005/0174025 | A1 * | 8/2005 | Okamoto | 313/143 |
| 2008/0238283 | A1 | 10/2008 | Nakamura et al. | 313/143 |
| 2011/0037373 | A1 | 2/2011 | Nakamura et al. | 313/141 |
| 2012/0248964 | A1 | 10/2012 | Thomas et al. | 313/141 |
| 2013/0285532 | A1 * | 10/2013 | Sakakura | 313/141 |

FOREIGN PATENT DOCUMENTS

| | | | |
|---|---|---|---|
| JP | 2009-224345 A | 10/2009 | H01T 13/20 |
| JP | 2012-216507 A | 11/2012 | H01T 13/54 |

OTHER PUBLICATIONS

Search Report issued in corresponding European Patent Application No. 14194934.7, dated May 8, 2015.

* cited by examiner

*Primary Examiner* — Nimeshkumar Patel
*Assistant Examiner* — Kevin Quarterman
(74) *Attorney, Agent, or Firm* — Kusner & Jaffe

(57) ABSTRACT

An ignition plug having a center electrode, a grounding electrode, an insulator, and a metal shell. The center electrode is held by the insulator, and the insulator is held by metal shell. A cavity is formed between the grounding electrode and the center electrode. The grounding electrode is joined to the inner wall surface of the metal shell via a melting portion. In the melting portion, in a predetermined cutting surface MS including a melting deepest point DP and a central axis CX, a percentage ratio MDD of a melting depth MD of the melting portion with respect to a thickness of the grounding electrode is 5% or more, and an area Sm of a portion included in an outer circumferential side of the metal shell is 10% or more of the entire area S.

13 Claims, 10 Drawing Sheets

Melting Depth Ratio

MDD = (MD / T) × 100 ≧ 5%

Melting Area Ratio

MSD = (Sm / S) × 100 ≧ 10%

FIG. 7

| Sample No. | Welding Condition | | Result | | |
|---|---|---|---|---|---|
| | Welding Position | Laser Output | Melting Area Ratio MSD | Melting Depth (MD) (Melting Depth Ratio MDD) | Welding Strength |
| S01 | −0.04mm | 102W | 22% | 0.36mm (18%) | 3600N |
| S02 | −0.04mm | 162W | 20% | 0.76mm (38%) | 3900N |
| S03 | −0.02mm | 122W | 29% | 0.54mm (27%) | 3900N |
| S04 | −0.02mm | 142W | 58% | 0.72mm (36%) | 4100N |
| S05 | 0.03mm | 132W | 40% | 0.62mm (31%) | 4000N |
| S06 | 0.08mm | 122W | 20% | 0.51mm (25.5%) | 3900N |
| S07 | 0.08mm | 142W | 54% | 0.77mm (38.5%) | 4100N |
| S08 | 0.10mm | 102W | 36% | 0.30mm (15%) | 3700N |
| S09 | −0.04mm | 72W | 8% | 0.12mm (6%) | 2700N |
| S10 | 0.03mm | 82W | 15% | 0.15mm (7.5%) | 3200N |
| S11 | 0.10mm | 72W | 13% | 0.07mm (3.5%) | 2900N |
| S12 | −0.05mm | 180W | 25% | 0.9mm (45%) | 4500N |
| S13 | 0.00mm | 184W | 26% | 1.06mm (53%) | 4700N |
| S14 | 0.04mm | 187W | 40% | 0.98mm (49%) | 4600N |
| S15 | −0.05mm | 188W | 37% | 0.98mm (49%) | 4600N |
| S16 | 0.05mm | 188W | 56% | 1.04mm (52%) | 4700N |

| Sample No. | S20 | S21 |
|---|---|---|
| Melting Portion Formation Range |  |  |
| | Range of Central Angle a=36° of Grounding Electrode | Range of Central Angle a=72° of Grounding Electrode |
| Welding Frequency | 30回 | 60回 |
| Melting Depth (MD) (Welding Depth Ratio MDD) | 0.62mm (31%) | 0.62mm (31%) |
| Melting Area Ratio (MSD) | 40% | 40% |
| Welding Strength | 2700N | 3900N |

SPARK PLUG

FIELD OF THE INVENTION

The present invention relates to a spark plug.

BACKGROUND OF THE INVENTION

A spark plug includes a center electrode and a grounding electrode. The center electrode is held by an insulator, and the grounding electrode is fixed to a metal shell which accommodates the insulator. A spark gap, which is a gap for generating spark discharge, is formed between the center electrode and the grounding electrode. The spark plug generates the spark discharge in the spark gap, and thus, ignites gas supplied into a combustion engine of an internal combustion engine.

Like the spark plug, a plasma jet ignition plug is known (for example, refer to JP-A-2009-224345). In the plasma jet ignition plug, the grounding electrode is joined to an inner circumferential surface of the metal shell and is integrated with the metal shell, the spark gap between the center electrode and the grounding electrode is surrounded by the insulator, and a discharge space having a small volume, referred to as a cavity, is formed.

In the plasma jet ignition plug, as described above, the grounding electrode is joined to the inner wall surface of the metal shell. In the plasma jet ignition plug, the joining property of the grounding electrode where it is secured to the metal shell, preferably, at a high level.

In the technology of JP-A-2009-224345, a tip portion of the insulator is strongly pressed to the grounding electrode, and thus, an object thereof is to prevent the insulator from being damaged. Accordingly, in JP-A-2009-224345, a special consideration is not made for the securing of the joining property of the grounding electrode with respect to the metal shell. Not only in the plasma jet ignition plug disclosed in JP-A-2009-224345, but also in a spark plug having a type in which a grounding electrode is welded to an inner wall surface of a metal shell as described in U.S. Pat. No. 6,064,144, there is still room for the improvement of the joining property of the grounding electrode with respect to the metal shell.

The present invention is made to solve the above-described problems, and can be realized according to the following aspects.

SUMMARY OF THE INVENTION

[1] According to an aspect of the present invention, there is provided a spark plug. The spark plug includes a shaft-shaped center electrode. A tubular insulator accommodates at least a rear end-side portion of the center electrode in an inner portion of the insulator. A grounding electrode is disposed to have a gap between a tip portion of the center electrode and the grounding electrode. A tubular metal shell includes a through-hole in which the insulator is accommodated. The grounding electrode may be fixed to an inner wall surface of the through-hole of the metal shell. The grounding electrode may be fixed to the metal shell via a melting portion in which the grounding electrode and the metal shell are melted to each other. In a cross section including a bottom portion of the melting portion, which is the rearmost end-side portion in the melting portion, and a central axis of the through-hole, in the melting portion, a melting depth, which is a distance in a central axis direction of the through-hole between a bottom portion of the melting portion and a virtual straight line including an outline of a tip-side surface of the grounding electrode, may be 5% or more of a thickness of the grounding electrode in the central axis direction. An area of the shell-side portion, which is positioned at an outer circumferential side of the metal shell from a virtual straight line connecting endpoints of the inner wall surface of the metal shell which are positioned at a tip side and a rear end side of the melting portion in the central axis direction, may be 10% or more of the entire area of the melting portion. According to the spark plug of this aspect, joining property between the grounding electrode and the metal shell is secured.

[2] In the melting portion of the spark plug according to another aspect of the present invention, there is provided, in the cross section, the melting depth may be 15% or more of the thickness of the grounding electrode in the central axis direction, and the area of the shell-side portion may be 20% or more of the entire area of the melting portion. According to the spark plug of this aspect, the joining property between the grounding electrode and the metal shell is secured at a higher level.

[3] In the melting portion of the spark plug according to another aspect of the present invention, in the cross section, the melting depth may be 25% or more of the thickness of the grounding electrode in the central axis direction. According to the spark plug of this aspect, the joining property between the grounding electrode and the metal shell is secured at a higher level.

[4] In a spark plug according to another aspect of the present invention, in the cross section of the melting portion, the melting depth may be 40% or more of the thickness of the grounding electrode in the central axis direction. According to the spark plug of this aspect, the joining property between the grounding electrode and the metal shell is secured at a higher level.

[5] In the melting portion of the spark plug according to another aspect of the present invention, in the cross section, the area of the shell-side portion is 26% or more of the entire area of the melting portion. According to the spark plug of this aspect, the joining property between the grounding electrode and the metal shell is secured at a higher level.

[6] In a spark plug according to another aspect of the present invention, the grounding electrode may include an outer circumferential end portion which comes into contact with the entire inner circumference of the inner wall surface in the through-hole of the metal shell, and the melting portion may be formed on the entire outer circumference side of the outer circumferential end portion. According to the spark plug of this aspect, the joining property of the grounding electrode having the outer circumferential end portion coming into contact with the entire inner circumference of the metal shell with respect to the metal shell is increased.

In a spark plug according to another aspect of the present invention, the grounding electrode includes: an arc shaped outer arc portion which is positioned at an outer circumferential side and faces the inner wall surface of the through-hole; an inner annular portion which surrounds an outer circumference of the tip portion of the center electrode; and a connection portion which is provided between the outer arc portion and the inner annular portion and connects the outer arc portion and the inner annular portion, and the melting portion may be formed at least between a portion of the outer arc portion to which the connection portion is connected, and a wall portion of the metal shell. According to the spark plug of this aspect, the joining property of the grounding electrode having the outer arc portion and the inner annular portion connected by the connection portion with respect to the metal shell is secured.

[8] In a spark plug according to another aspect of the present invention, the connection portion may include a plurality of columnar connection portions radially extending toward the outer arc portion from the inner annular portion, and the melting portion may be formed to correspond to at least each of the plurality of columnar connection portions. According to the spark plug of this aspect, the joining property of the grounding electrode including the outer arc portion and the inner annular portion with respect to the metal shell is secured at a higher level.

The present invention can be realized in various aspects other than the spark plug. For example, the present invention may be realized in aspects such as a manufacturing method or a manufacturing apparatus of the spark plug, a joining method or a joining apparatus of the grounding electrode and the metal shell, a computer program for realizing the methods and apparatuses, and a recording medium which records the computer program and which is not temporary.

BRIEF DESCRIPTION OF THE DRAWINGS

FIG. 7 is an explanatory view showing a result of a verification experiment of welding strength between the grounding electrode and the metal shell.

DETAILED DESCRIPTION OF PREFERRED EMBODIMENTS

A. First Embodiment

Figure 1:
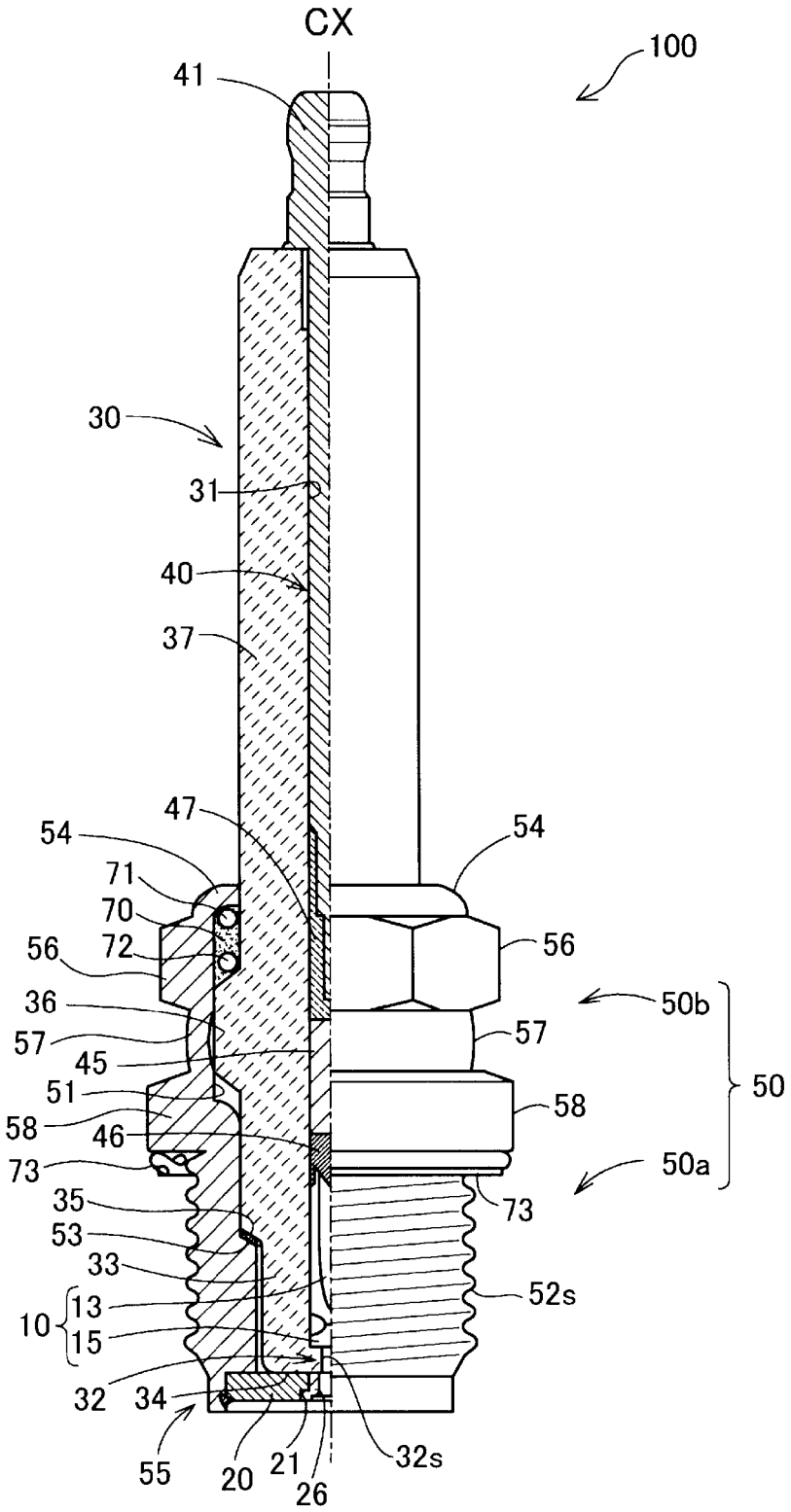
FIG. 1 is a schematic view showing a configuration of a plasma jet ignition plug.

FIG. 1 is a schematic view showing a configuration of a plasma jet ignition plug 100 (hereinafter, simply referred to as an "ignition plug 100") according to a first embodiment of the present invention. In FIG. 1, a central axis CX of the ignition plug 100 is indicated by a dashed line. In the present specification, a direction parallel to the central axis CX is also referred to as a "central axis direction". In FIG. 1, for convenience, a left side of a paper surface from the central axis CX of the ignition plug 100 is shown by a schematic sectional view, and a right side of the paper surface from the central axis CX is shown by a schematic appearance view.

The ignition plug 100 is attached to a combustion chamber of an internal combustion engine in which diluted mixed gas is used as the fuel gas, and is used for the ignition of the fuel gas. In the ignition plug 100, a tip side (lower side of the paper surface) is disposed in the combustion chamber, and the rear end side (upper side of the paper surface) is disposed on the outer portion of the combustion chamber. In the ignition plug 100, plasma is generated in the tip side disposed in the combustion chamber and is injected, and thus, it is possible to secure high ignitability with respect to the fuel gas having a high ignition limit air-fuel ratio.

The ignition plug 100 includes a center electrode 10, a grounding electrode 20, an insulator 30, a terminal electrode 40, and a metal shell 50. The center electrode 10 is configured of a shaft-shaped electrode member, and includes a metal core 13, which is configured of a metal such as copper having excellent thermal conductivity, in the inner portion of the center electrode. The center electrode 10 includes a disk-shaped electrode tip 15, which is configured of alloy having noble metal, tungsten, or the like as main components, on the tip of the center electrode. The electrode tip 15 is integrated with the center electrode 10 by welding. The electrode tip 15 may be omitted. The center electrode 10 is held in an axial hole 31 of the insulator 30 on the central axis CX. The center electrode 10 is electrically connected to an external power source via the terminal electrode 40 which is held on the rear end side of the axial hole 31 of the insulator 30.

The grounding electrode 20 is an approximately disk-shaped electrode member having a through-hole 21 in the center thereof. An approximately cylindrical noble metal tip 26 is attached so as to be integrated with the through-hole 21 of the grounding electrode 20. The noble metal tip 26 may be omitted. The grounding electrode 20 is joined so as to be integrated with the metal shell 50 in a state where the outer circumferential end surface of the grounding electrode comes into contact with the inner wall surface of the metal shell 50. In the ignition plug 100 of the present embodiment, joining strength (welding strength) of the grounding electrode 20 with respect to the metal shell 50 is secured by laser welding. The details of an attachment state of the grounding electrode 20 with respect to the metal shell 50 or an attachment method will be described below.

The insulator 30 is a shaft-shaped member having an axial hole 31 penetrating the center of the insulator, and, for example, is configured of a ceramic sintered body such as alumina or aluminum nitride. The insulator 30 includes a tip-side portion 33 extending to the tip side, a flange portion 36 positioned at the rear end of the tip-side portion 33, and a rear end-side portion 37 extending from the flange portion 36 to the rear end side. A stepped surface 35 which is an annular surface facing the tip side is formed in the vicinity of the center portion in the central axis direction of the tip-side portion 33. The diameter of the tip side of the tip side portion 33 is smaller than that of the rear end side, with the stepped surface 35 as a boundary. The diameter of the flange portion 36 locally becomes larger than diameters of other portions in the rear step side of the stepped surface 35, and thus, the flange portion 36 is an annular portion which protrudes in a radial direction (a direction perpendicular to the central axis CX) of the insulator 30. The central axis of the insulator 30 coincides with the central axis CX of the ignition plug 100. At least the tip-side portion 33 is accommodated in a cylindrical hole 51 of the metal shell 50. The rear end-side portion 37 extends from the rear end-side opening of the metal shell 50, and thus, the insulator 30 is held by the metal shell 50.

As described above, the center electrode 10 is held in the axial hole 31 of the tip-side portion 33 of the insulator 30. A reduced-diameter opening portion 32 in which the opening diameter of the axial hole 31 is decreased is formed on the tip portion of the insulator 30. The peripheral edge of the tip surface of the electrode tip 15 positioned at the tip of the center electrode 10 abuts onto the stepped surface of the rear end side of the reduced-diameter opening portion 32 so as to be locked thereto. In the ignition plug 100, the plasma is formed in an internal space 32*s* of the reduced-diameter opening portion 32 (the details will be described below). Hereinafter, the internal space 32*s* also is referred to as a "cavity 32*s*." The terminal electrode 40 which is a shaft-shaped electrode member is held in the axial hole 31 of the rear end-side portion 37 of the insulator 30. A resistor 45 is disposed between the center electrode 10 in the axial hole 31 of the insulator 30 and the terminal electrode 40. A first seal material and a second seal material 46 and 47 are disposed on the tip side and the rear end side of the resistor 45, respectively. The center electrode 10 and the terminal electrode 40 are electrically connected to each other via the resistor 45 which is interposed between the first glass seal material 46 and the second glass seal material 47. Accordingly, in the ignition plug 100, occurrence of radio noise is prevented when spark discharge is generated. In addition, the resistor 45 may be omitted.

The metal shell 50 is an approximately cylindrical member having a cylindrical hole 51 at the center thereof, and configures a housing of the ignition plug 100. For example, the metal shell 50 is configured of metal such as carbon steel. The central axis of the metal shell 50 coincides with the central axis CX of the ignition plug 100. The metal shell 50 includes a shell tip-side portion 50*a* which is disposed inside the attachment hole (not shown) of the internal combustion engine, and a shell rear end-side portion 50*b* which is disposed outside the attachment hole.

As described above, the grounding electrode 20 is attached to the tip-side opening end portion 55 of the cylindrical hole 51 in the shell tip-side portion 50*a*. Moreover, the center electrode 10 held by the tip-side portion 33 of the insulator 30 is accommodated in the cylindrical hole 51 of the shell tip-side portion 50*a*. A screw portion 52*s* is formed on the outer circumferential surface of the shell tip-side portion 50*a* and is dimensioned to be screwed to a threaded groove provided on the inner circumferential surface of the attachment hole of the internal combustion engine. A threaded groove is provided in the screw portion 52*s* to fix the ignition plug 100 to the combustion chamber of the internal combustion engine.

The shell rear end-side portion 50*b* includes a crimping portion 54 for fixing the insulator 30 to the opening end portion of the rear end side. The crimping portion 54 is formed to crimp the opening end portion of the rear end side of the shell rear end-side portion 50*b* to the inside in a state where the flange portion 36 of the insulator 30 is accommodated in the cylindrical hole 51 and the stepped surface 35 of the insulator 30 engages with a protrusion 53 of the cylindrical hole 51. In addition, a talc layer 70 filled with talc powder and ring-shaped wire packings 71 and 72 are disposed between the inner wall surface of the crimping portion 54 and the rear end-side surface of the flange portion 36 of the insulator 30. Accordingly, air-tightness is secured between the metal shell 50 and the insulator 30.

In addition, the shell rear end-side portion 50*b* includes a tool engaging portion 56, a thin portion 57, and a flange portion 58 in this order from the rear end side. The tool engaging portion 56 has a polygonal cross section protruding in the radial direction, and is formed at a position adjacent to the crimping portion 54. When the ignition plug 100 is attached to the internal combustion engine, a tool such as a spanner engages with the tool engaging portion 56. The thin portion 57 is a portion which is positioned between the tool engaging portion 56 and the flange portion 58. The thin portion 57 is a portion having the thinnest thickness in the metal shell 50, and when the crimping portion 54 is formed, the thin portion is slightly bent to the outside by the external force applied to the metal shell 50.

The flange portion 58 is an annular portion protruding in the radial direction (the direction perpendicular to the central axis CX) of the metal shell 50, and is formed on the tip-side end portion of the shell rear end-side portion 50*b*. The flange portion 58 is disposed outside the combustion chamber when the ignition plug 100 is attached to the internal combustion engine. A ring-shaped gasket 73 is disposed on the tip-side surface of the flange portion 58. The gasket 73 is pressed by the flange portion 58 when the ignition plug 100 is attached to the internal combustion engine, and is sealed between the combustion engine and the metal shell 50.

Figure 2:
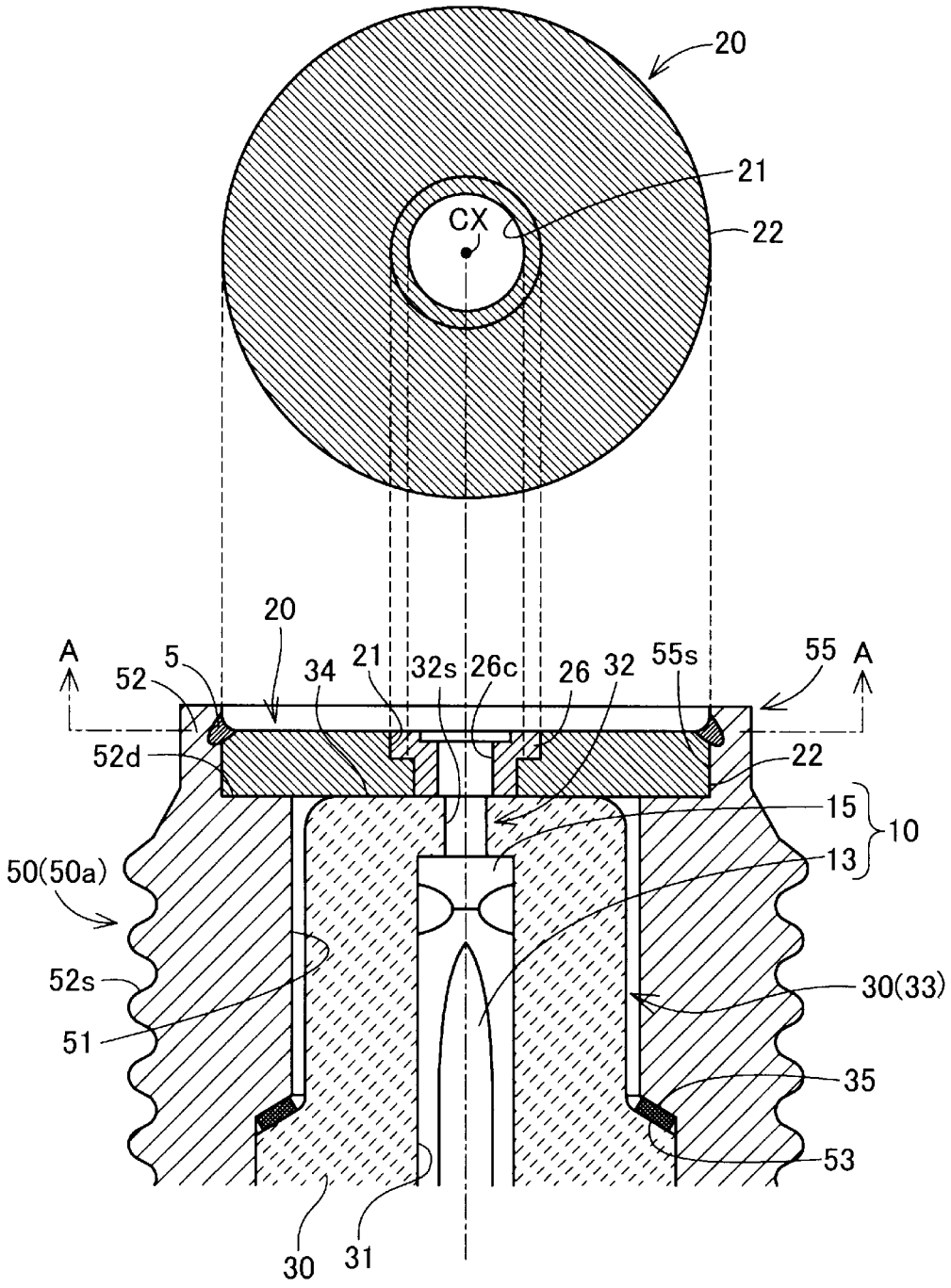
FIG. 2 is a schematic view for explaining an attachment state and an attachment method of a grounding electrode with respect to a metal shell.

FIG. 2 is a schematic view for explaining the attachment state and the attachment method of the grounding electrode 20 with respect to the metal shell 50. In the upper portion of the paper surface of FIG. 2, the front surface side of the grounding electrode 20 when viewed in the central axis direction is shown. In the present specification, the "front surface" in the grounding electrode 20 indicates the surface facing the tip side when the grounding electrode is attached to the ignition plug 100, and the "rear surface" indicates the surface facing the rear end side. In the lower portion of the paper surface of FIG. 2, a schematic cross-sectional configuration of the ignition plug 100 after the grounding electrode 20 is joined to the metal shell 50 is shown. In the lower portion of the paper surface of FIG. 2, the ignition plug 100 is shown in a direction opposite to FIG. 1, that is, a direction in which the upper side in the paper surface is defined as the tip side and the lower side in the paper surface is defined as the rear end side. In FIG. 2, the grounding electrode 20 of the upper portion of the paper surface and the grounding electrode 20 of the lower portion of the paper surface are shown so as to correspond to each other.

As described above, the grounding electrode 20 has an approximately disk shape including the through-hole 21 in the center thereof. The grounding electrode 20 is attached to the metal shell 50 in a state where the outer circumferential end surface 22 comes into contact with an inner wall surface 55*s* of the tip-side opening end portion 55 of the metal shell 50. The outer circumferential edge in the rear surface side of the grounding electrode 20 opposes the stepped surface 52*d* facing the tip side in the cylindrical hole 51 of the metal shell 50. In addition, the inner circumferential edge around the through-hole 21 in the rear surface side of the grounding electrode 20 opposes the tip surface 34 around the reduced-diameter opening portion 32 of the insulator 30. The noble metal tip 26 is attached to engage with the inner circumferential wall surface of the through-hole 21 of the grounding electrode 20. The cavity 32*s* formed on the tip of the insulator 30 communicates with the cylindrical hole 26*c* of the noble metal tip 26 and communicates with the outside via the cylindrical hole 26*c*. That is, it can be regarded that the cavity 32*s* communicates with the outside via the through-hole 21 of the grounding electrode 20.

The cavity 32*s* is disposed between the electrode tip 15 of the tip portion of the center electrode 10 and the noble metal tip 26 in the through-hole 21 of the grounding electrode 20. In the ignition plug 100, a pathway of spark discharge between the center electrode 10 and the grounding electrode 20 is formed in the cavity 32*s*. That is, a spark gap of the ignition plug 100 is surrounded by the insulator 30. In the ignition plug 100, when a high voltage is applied to the center electrode 10 via the terminal electrode 40 (FIG. 1), the spark discharge is generated between the center electrode 10 and the grounding electrode 20, and plasma is formed in the cavity 32*s* by the spark discharge. The plasma is injected to the tip side via the through-hole 21 (more specifically, the cylindrical hole 26*c* of the noble metal tip 26) of the grounding electrode 20 from the cavity 32*s*, and thus, ignites the fuel gas in the combustion chamber.

As described below, the grounding electrode 20 is attached to the cylindrical hole 51 in the shell tip-side portion 50*a* of the metal shell 50 and is integrated therewith. The diameter of the grounding electrode 20 is approximately the same as the opening diameter of the tip-side opening end portion 55 of the metal shell 50. First, the outer circumferential end surface 22 of the grounding electrode 20 and the inner wall surface 55*s* in the tip-side opening end portion 55 of the metal shell 50 come into surface-contact with each other, and the grounding electrode 20 is fitted into the cylindrical hole 51 of the metal shell 50 so that the central axis of the grounding electrode 20 coincides with the central axis CX.

As described above, the annular stepped surface 52*d* facing the tip side is formed in the cylindrical hole 51 of the shell tip-side portion 50*a*. The outer circumferential end portion of the grounding electrode 20 is disposed so as to be locked to the stepped surface 52*d* of the cylindrical hole 51.

After the grounding electrode 20 is disposed on the stepped surface 52*d* of the shell tip-side portion 50*a*, the grounding electrode is joined to a cylindrical wall portion 52 of the shell tip-side portion 50*a* by laser welding. By the laser welding, the constituent material of the grounding electrode 20 and the constituent material of the metal shell 50 are melted to each other in a portion between the outer circumferential end portion of the grounding electrode 20 and the cylindrical wall portion 52 in the tip-side opening end portion 55 of the shell tip-side portion 50*a*, and thus, a melting portion 5 is formed.

Figure 3:
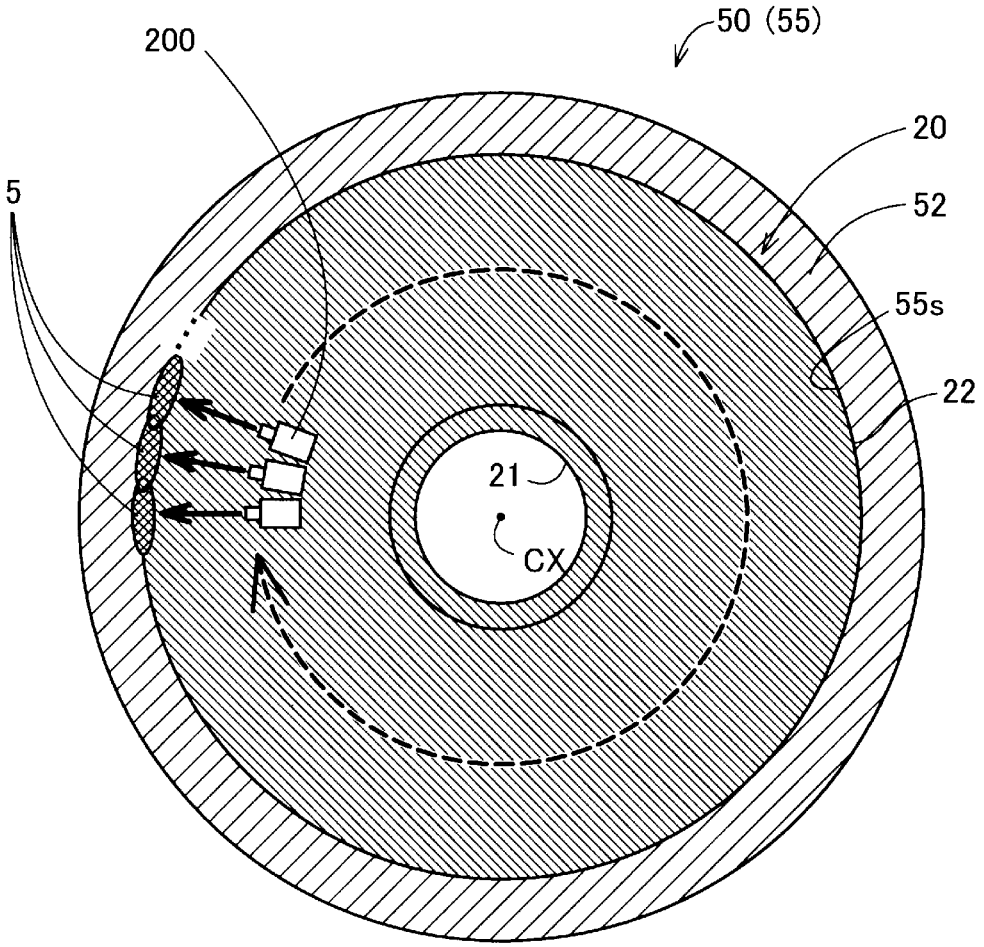
FIG. 3 is a schematic view for explaining a process of laser welding of the grounding electrode with respect to the metal shell.

FIG. 3 is a schematic view for explaining the process of the laser welding of the grounding electrode 20 with respect to the metal shell 50. FIG. 3 shows a schematic cross section of the metal shell 50 at a position cut along line A-A of FIG. 2 in a state where the grounding electrode 20 is fitted to the tip-side opening end portion 55. In FIG. 3, a moving locus of a laser emitting portion 200 in the laser welding process is schematically shown. In the laser welding process with respect to the grounding electrode 20, the laser is emitted from the laser emitting portion 200 of a laser welding machine over the entire outer circumference of the grounding electrode 20 with a predetermined interval in plural times (for example, approximately 80 to 120 times). Accordingly, the plurality of melting portions 5 are formed over the entire outer circumference of the grounding electrode 20 in a state where the melting portions adjacent to each other are connected to each other so as to overlap in the end portions.

Figure 4:
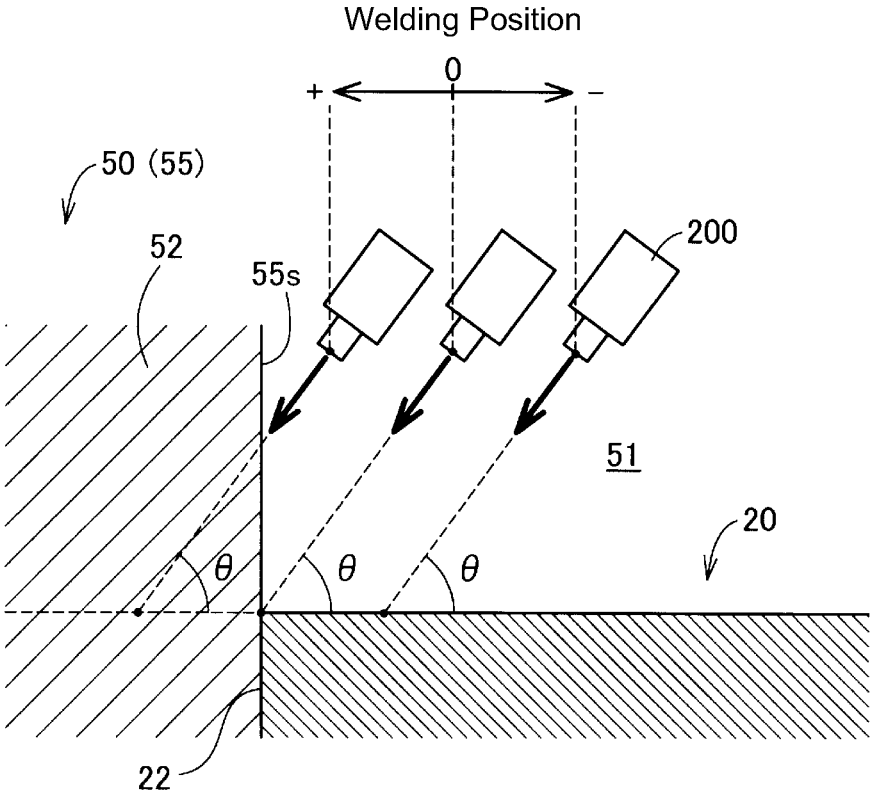
FIG. 4 is a schematic view for explaining a welding position when a melting portion is formed.

FIG. 4 is a schematic view for explaining a welding position when the melting portion 5 is formed. FIG. 4 shows a schematic cross section at the boundary between the grounding electrode 20 and the tip-side opening end portion 55 of the metal shell 50 before the laser welding is performed. In FIG. 4, a plurality of the laser emitting portions 200 when the laser is emitted at positions different from one another are shown. When the melting portion 5 is formed, the laser emitting portion 200 emits laser to the position at which the melting portion 5 is formed while maintaining a predetermined angle θ which is set in advance with respect to the radial direction (a horizontal direction in the paper surface) of the grounding electrode 20 or the metal shell 50.

The forming position of the melting portion 5 in the radial direction of the grounding electrode 20 or the metal shell 50 is adjusted by the position of the laser emitting portion 200 in the radial direction. In the present specification, the position of the laser emitting portion 200 in the radial direction when the melting portion 5 is formed is referred to as the "welding position". When the position of the laser emitting portion 200 when laser is emitted to the boundary position between the outer circumferential end surface 22 of the grounding electrode 20 and the inner wall surface 55*s* of the metal shell 50 is defined as a starting point, the welding position is represented by a movement distance of the laser emitting portion 200 with respect to the starting point. Moreover, in the welding position, a direction (a direction toward the outer circumferential side) in which the laser emitting portion 200 approaches the cylindrical wall portion 52 of the tip-side opening end portion 55 is defined as a plus direction, and a direction (a direction toward the inner circumferential direction) away from the cylindrical wall portion 52 is defined as a minus direction.

In the ignition plug 100, since the grounding electrode 20 is directly exposed to a high combustion pressure in the combustion chamber, preferably, the grounding electrode 20 and the metal shell 50 are joined to each other by higher welding strength. The inventors of the present invention found that the melting portion 5 was formed to have a predetermined melting depth and a predetermined area in a predetermined cutting surface MS described below, and thus, high welding strength was secured between the grounding electrode 20 and the metal shell 50.

Figure 5:
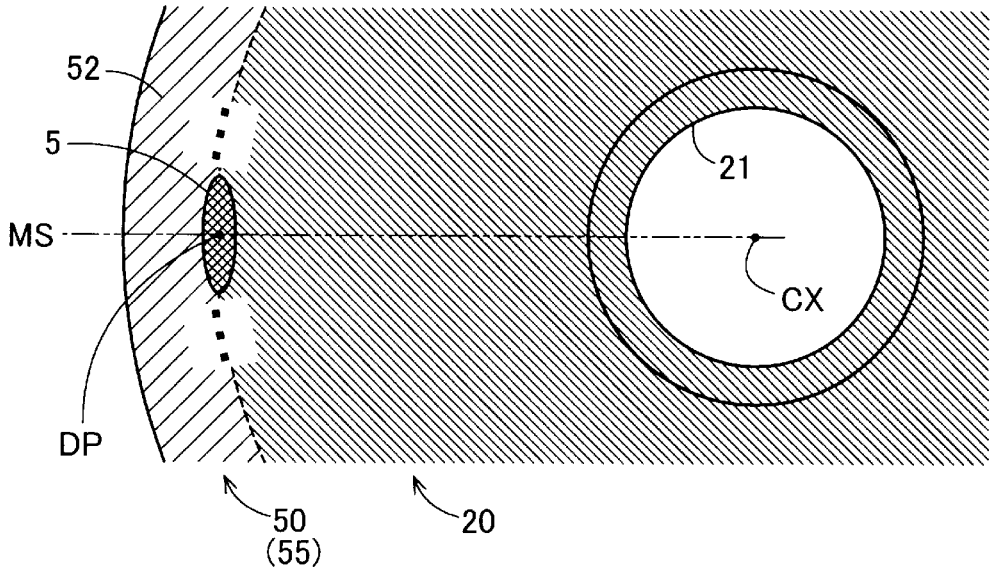
FIG. 5 is a schematic view showing a predetermined cutting surface for defining the melting portion.

FIG. 5 is a schematic view showing the predetermined cutting surface MS for defining the melting portion 5. FIG. 5 shows a portion of a schematic cross section of the metal shell 50 after the grounding electrode 20 is joined in the cutting position similar to FIG. 3. In FIG. 5, only one arbitrary meting portion 5 among the plurality of melting portions 5 formed over the entire outer circumference of the grounding electrode 20 is shown.

The cutting surface MS (shown by a two-dot chain line) is a surface which is defined by the melting deepest point DP of the melting portion 5 and the central axis (central axis CX) of the metal shell 50. The "melting deepest point DP of the melting portion 5" is a portion which is positioned at the rearmost end side in the melting portion 5. That is, the melting deepest point is a bottom portion in which a penetration depth of the melting portion 5 in the central axis direction becomes the maximum, and is a portion in which a distance in the central axis direction from a virtual plane defined by the tip-side surface of the grounding electrode 20 having the formed melting portion 5 becomes the maximum.

Figure 6:
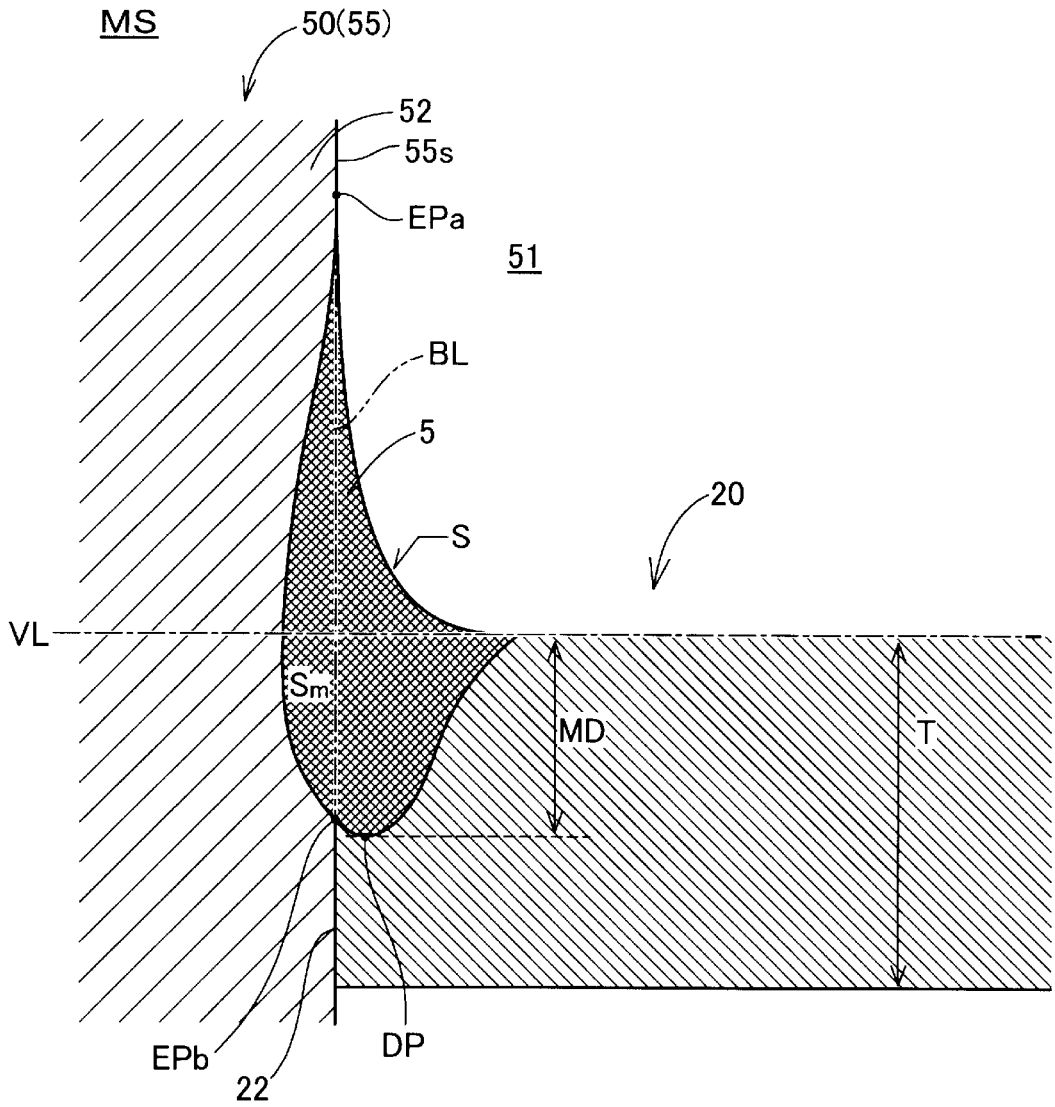
FIG. 6 is a schematic sectional view for explaining a cross-sectional configuration of the melting portion on the predetermined cutting surface.

FIG. 6 is a schematic sectional view for explaining the cross-sectional configuration of the melting portion 5 on the predetermined cutting surface (i.e., plane) MS. In the present specification, a percentage ratio of the melting depth MD of the melting portion 5 on the cutting surface MS with respect to a thickness T in the central axis direction of the grounding electrode 20 is referred to as a "melting depth ratio MDD" (the following Expression (1)). Here, the "melting depth MD of the melting portion 5" is the maximum distance between the melting deepest point DP and a virtual straight line VL (shown by a dashed line) defined by the tip-side surface of the grounding electrode 20 having the formed melting portion 5.

$$MDD=(MD/T)\times 100 \quad (1)$$

In addition, in the present specification, a percentage ratio of an area Sm of the metal shell 50 side of the melting portion 5 in the cutting surface MS with respect to the overall area S of the melting portion 5 on the predetermined cutting surface MS is referred to as a "melting area ratio MSD" (the following Expression (2)). The "area Sm of the metal shell 50 side of the melting portion 5 in the cutting surface MS" is an area of the melting portion 5 which is included in the outer circumferential side (cylindrical wall portion 52 side) from a virtual boundary straight line BL (shown by a two-dot chain line) connecting endpoints EPa and EPb of the inner wall surface 55*s* of the metal shell 50 which are positioned at the tip side and the rear end side of the melting portion 5, in the cutting surface MS.

$$MSD=(Sm/S)\times 100 \quad (2)$$

The melting depth ratio MDD of the melting portion 5 can be adjusted by a laser output when the melting portion 5 is formed. In addition, the melting area ratio MSD is adjusted by the laser output and the welding position when the melting portion 5 is formed.

In the ignition plug 100 of the present embodiment, each melting portion 5 is formed so that the melting depth ratio MDD is 5% or more and the melting area ratio MSD is 10% or more in the cutting surface MS (the following Inequality Expression (3)).

$$MDD\geq 5\% \text{ and } MDS\geq 10\% \quad (3)$$

Accordingly, high welding strength is secured between the grounding electrode 20 and the metal shell 50.

Here, in each melting portion 5, more preferably, the melting depth ratio MDD is 15% or more, and the melting area ratio MSD is 20% or more in the predetermined cutting surface MS (the following Inequality Expression (3a)).

$$MDD\geq 15\% \text{ and } MSD\geq 20\% \quad (3a)$$

Alternatively, in each melting portion 5, preferably, the melting depth ratio MDD is 20% or more, or the melting area ratio MSD is 20% or more in the predetermined cutting surface MS (the following Inequality Expression (3b)).

$$MDD\geq 20\% \text{ or } MSD\geq 20\% \quad (3b)$$

In addition, the melting area ratio MSD in the predetermined cutting surface MS of each melting portion 5 may be 90% or less (MSD≤90%), and preferably, is 80% or less (MSD≤80%). More preferably, the melting area ratio MSD in the predetermined cutting surface MS is 60% or less (MSD≤60%).

In the ignition plug 100 of the present embodiment, the relationship of Inequality Expression (3) may not be satisfied in the cutting surfaces MS of all melting portions 5 formed on the outer circumference of the grounding electrode 20. Specifically, in the present embodiment, the relationship of Inequality Expression (3) may be satisfied in the cutting surfaces MS of the melting portions having the number exceeding 90% among all melting portions 5.

FIG. 7 is an explanatory view showing a result of a verification experiment of welding strength between the grounding electrode 20 and the metal shell 50. In the verification experiment, a test of the welding strength was performed with respect to test pieces (samples S01 to S16) used in the ignition plug 100 of the present embodiment in which the grounding electrode 20 was welded to the metal shell 50 by laser. In each of the samples S01 to S16, each melting portion 5 was formed according to the welding positions and laser outputs indicated by the table of FIG. 7. Moreover, also in any of the samples S01 to S16, the emission of the laser was performed for 100 times in order to form the melting portion 5 over the entire outer circumference of the grounding electrode 20.

The melting area ratio MSD, the melting depth MD, and the melting depth ratio MDD of each of the samples S01 to S16 were measured by cutting an arbitrary melting portion 5 according to the cross section corresponding to the predetermined cutting surface M after the test of the welding strength. The test of the welding strength in each of the samples S01 to S16 was performed by applying a load in the central axis direction to the grounding electrode 20 at a crosshead speed of 5 mm/min using a compression tester (load capacity: 50 kN). Moreover, the measured results of the welding strength shown in FIG. 7 are average values of the measured results in which tests are performed for 3 times with respect to each of the samples S01 to S16.

Figure 8:
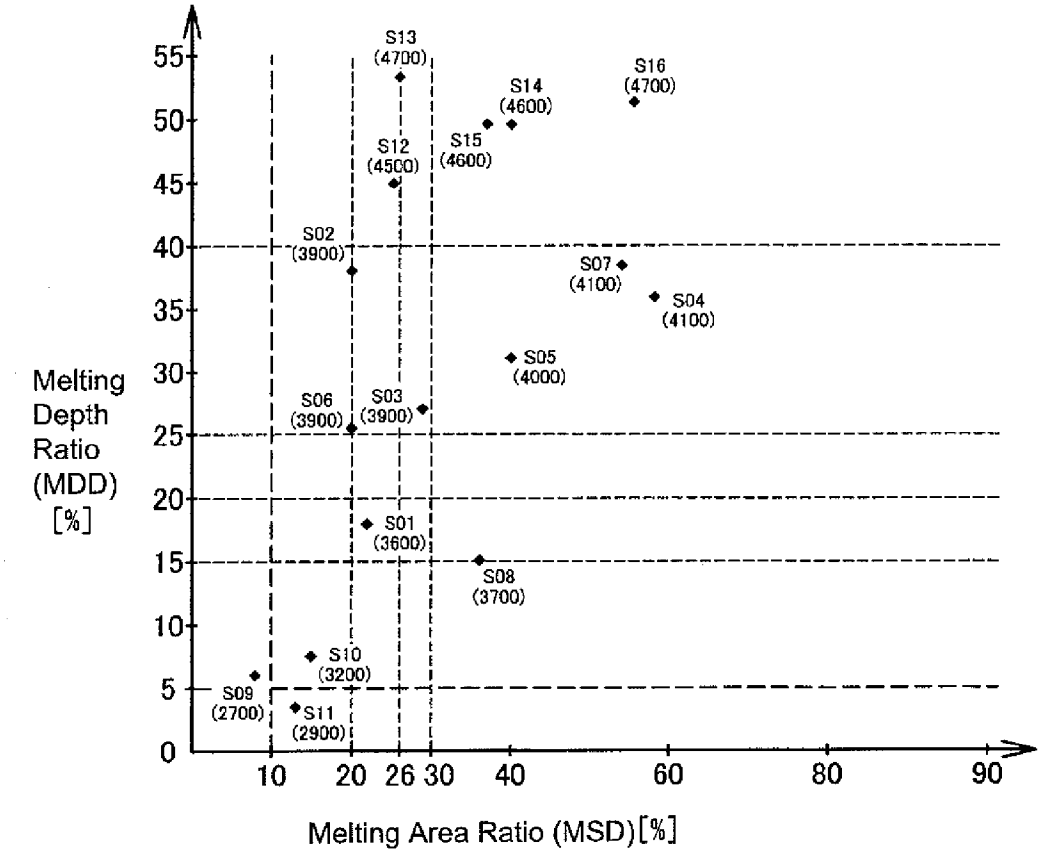
FIG. 8 is an explanatory view showing scattered plots of the test results of the welding strength.

FIG. 8 is an explanatory view showing scattered plots of the test results in the welding strength of each of the samples S01 to S16. In FIG. 8, the scattered plots of the measured results of the welding strength in each of the samples S01 to S16 are shown in a state where a vertical axis is defined as the melting depth ratio MDD and a horizontal axis is defined as the melting area ratio MSD. In the samples S01 to S08, S10, and S12 to S16 in which the melting depth ratio MDD was 5% or more and the melting area ratio MSD was 10% or more, the welding strength was more than 2900 N. In the samples S01 to S08 and S12 to S16 in which the melting depth ratio MDD was 15% or more and the melting area ratio MSD was 20% or more, the welding strength was more than 3500 N.

Also in the samples S02 to S07 and S12 to S16 in which the melting depth ratio MDD was 20% or more or the melting area ratio MSD was 20% or more, the welding strength of 3900 N or more was secured. In the samples S03 to S05, S08, and S12 to S16 in which the melting area ratio MSD was 26% or more, the welding strength of 3700 N or more was secured. In the samples S02 to S07 and S12 to S16 in which the melting depth ratio MDD was 25% or more, the welding strength of 3900 N or more was secured. In the samples S03 to S05, S07, S08, and S13 to S16 in which the melting area ratio MSD was 26% or more, the welding strength of 3700 N or more was secured. In the samples S03 to S05, S07, and S13 to S16 in which the melting depth ratio MDD was 25% or more or the melting area ratio MSD was 26% or more, the welding strength of 3900 N or more was secured. In the samples S04, S05, S07, and S14 to S16 in which the melting depth ratio MDD was 25% or more or the melting area ratio MSD was 30% or more, the welding strength of 4000 N or more was secured. In the samples S12 to S16 in which the melting depth ratio MDD was 40% or more, the welding strength of 4500 N or more was secured. In the samples S13 to S16 in which the melting depth ratio MDD was 40% or more and the melting area ratio MSD was 26% or more, the welding strength of 4600 N or more was secured.

As described above, according to the ignition plug 100 of the present embodiment, the melting depth ratio MDD or the melting area ratio MSD are appropriately defined in the predetermined cutting surface MS of each of the melting portions 5 formed over the entire outer circumference of the grounding electrode 20. Accordingly, the welding strength between the grounding electrode 20 and the metal shell 50 is secured.

B. Second Embodiment

In the first embodiment, the configuration in which the melting portions 5 are formed over the entire outer circumference of the grounding electrode 20 having an approximately disk shape is described. On the other hand, hereinafter, a configuration in which the melting portions 5 are formed on a grounding electrode 20A which does not have an approximately disk shape will be described as a second embodiment of the present invention. In addition, in descriptions below, the same reference numerals are used for the elements common to the first embodiment.

Figure 9:
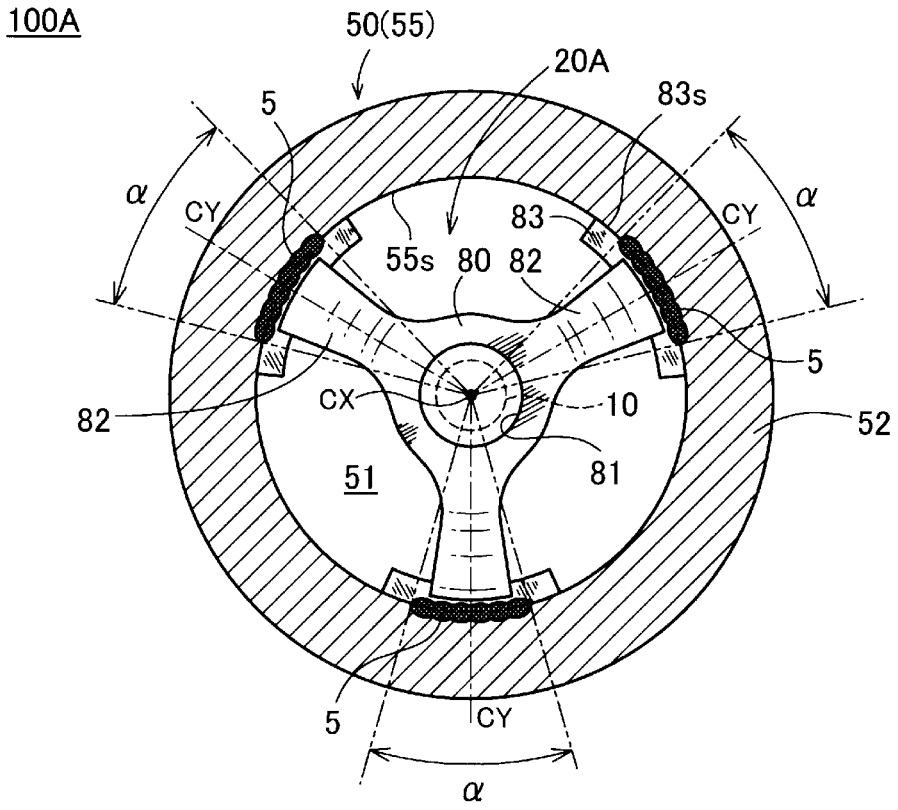
FIG. 9 is a schematic view showing a configuration of a grounding electrode having a spark plug of a second embodiment.

FIG. 9 is a schematic view showing the grounding electrode 20A included in a spark plug 100A of the second embodiment of the present invention. FIG. 9 shows a schematic cross section of the metal shell 50 at a position corresponding to the cutting along line A-A of FIG. 2 after the grounding electrode 20A is joined. In FIG. 9, the disposition position of the center electrode 10 is shown by a broken line. Moreover, in FIG. 9, a central axis CY of each columnar connection portion 82 is shown by a dashed line.

The spark plug 100A of the second embodiment can ignite the fuel gas by the spark discharge generated in the spark gap between the center electrode 10 and the grounding electrode 20A. The spark plug 100A of the second embodiment is the same as the configuration of the ignition plug 100 of the first embodiment except that the tip portion of the center electrode 10 extends from the tip portion of the insulator 30 and the configuration of the grounding electrode 20A is different from that of the grounding electrode 20. The grounding electrode 20A of the second embodiment is attached to the tip-side end portion of the metal shell 50 and is integrated with the metal shell 50 so that the center axis of the grounding electrode 20A coincides with the central axis CX of the spark plug. Hereinafter, the central axis CX of the spark plug will be described as the central axis of the grounding electrode 20A.

The grounding electrode 20A includes a central annular portion 80, three columnar connection portions 82, and three arc-shaped connection portions 83. The central annular portion 80 is an approximately annular portion having a through-hole 81 in the center of the central annular portion, and is positioned at the center of the grounding electrode 20. The central annular portion 80 corresponds to an inner annular portion. In the spark plug of the second embodiment, the tip of the center electrode 10 is positioned at the center in the through-hole 81 in the central annular portion 80 of the grounding electrode 20A, and a spark gap is formed in the through-hole 81. Each columnar connection portion 82 radially extends with the outer circumferential end portion of the central annular portion 80 as an initial point, and extends to the tip side while having an inclination angle with respect to the central axis direction. When viewed in the central axis direction, the columnar connection portions 82 are arranged in approximately equal intervals about the central annular portion 80 so that the angles between the central axes CY are approximately equal to one another. The arc-shaped connection portion 83 is provided on the end portion opposite the central axis CX side of each columnar connection portion 82. Each columnar connection portion 82 is connected to the center portion of the arc-shaped connection portion 83. Each arc-shaped connection portion 83 extends to be bent in an approximately arc shape in the circumferential shape of the central axis CX. The arc-shaped connection portion 83 corresponds to an outer arc portion.

After the grounding electrode 20A is disposed in the cylindrical hole 51 of the metal shell 50 so that an outer circumferential arc surface 83*s* of each arc-shaped connection portion 83 comes into surface contact with the inner wall surface 55*s* in the tip-side opening end portion 55 of the metal shell 50, the grounding electrode 20A is joined to the cylindrical wall portion 52 in the tip-side opening end portion 55 of the metal shell 50 by laser welding. By the laser welding, the plurality of melting portions 5 are formed at the boundary position between each arc-shaped connection portion 83 and the metal shell 50. Similar to the first embodiment, the plurality of melting portions 5 are formed in the state where the melting portions adjacent to each other are connected to each other so as to overlap in the end portions. Moreover, similar to the melting portion 5 described in the first embodiment, also in the second embodiment, the melting portion 5 is formed so that the melting depth ratio MDD and the melting area ratio MSD in the predetermined cutting surface MS satisfy the relationship of the above-described Inequality Expression (3).

In the spark plug 100A of the second embodiment, it can be regarded that the melting portion 5 is formed at the position corresponding to the columnar connection portion 82 of the grounding electrode 20A. The welding strength between the grounding electrode 20A and the metal shell 50 is increased as a formation range of the melting portion 5 on the arc-shaped connection portion 83 about each columnar connection portion 82 is increased. The formation range of the melting portion 5 in each arc-shaped connection portion 83 is a range about the central axis CY of the columnar connection portion 82, preferably, a central angle $\alpha$ is in a range of 36° or more, and more preferably, the central angle $\alpha$ is in a range of 72° or more.

Figure 10:
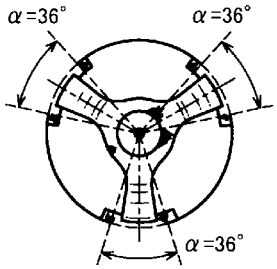
FIG. 10 is an explanatory view showing results of a verification experiment of welding strength between a grounding electrode and a metal shell in a configuration in which the melting portion is not formed over the entire outer circumference of the grounding electrode.
Figure 10:
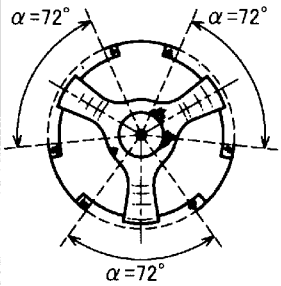

FIG. 10 is an explanatory view showing a result of a verification experiment of welding strength between the grounding electrode 20A and the metal shell 50 in the spark plug 100A of the second embodiment. In this verification experiment, as described below, under the same conditions as those described in the first embodiment, the test of the welding strength was performed on test pieces (samples S20 and S21) of the grounding electrode 20A and the metal shell 50 connected to each other by laser welding. In the table of FIG. 10, a schematic view showing the configurations of samples S20 and S21, the formation range of the melting portion 5, an emitting frequency of laser for welding, the melting depth MD (melting depth ratio MDD), the melting area ratio MSD, and the welding strength which is the test result are given.

The samples S20 and S21 are test pieces of the grounding electrode 20A and the metal shell 50 used in the spark plug 100A of the second embodiment. In the sample S20, the melting portion 5 was formed over a range about the central axis CY of each of three columnar connection portions 82 and a range in which the central angle $\alpha$ became approximately 36°. In the sample S21, the melting portion 5 was formed over a range about the central axis CY of each of three columnar connection portions 82 and a range in which the central angle $\alpha$ became approximately 72°.

In this verification experiment, regardless that the melting portion 5 was not formed over the entire outer circumference of the grounding electrode 20, and also in any of samples S20 and S21, the welding strength of 2500 N or more was secured. Particularly, in the sample S21, the welding strength of 3900 N was secured, and the welding strength having the approximately same level as the samples S01 to S08 and S12 to S16 (FIG. 7) described in the first embodiment in which the melting portions 5 were formed over the entire outer circumference of the grounding electrode 20 was secured. As a result, it is understood that, more preferably, the melting portions 5 are formed within a range in which the melting portions occupy 60% or more of the outer circumference of the grounding electrode 20A at the positions corresponding to the columnar connection portion 82.

As described above, even when the melting portions 5 are not formed over the entire outer circumference of the grounding electrode 20, if the melting depth ratio MDD and the melting area ratio MSD of the melting portion 5 are appropriately defined, it is possible to secure high welding strength between the grounding electrode 20 and the metal shell 50. In addition, the position or the range within which the melting portion 5 is formed on the outer circumferential edge of the grounding electrode 20 is appropriately defined, and thus, it is possible to improve the welding strength between the grounding electrode 20 and the metal shell 50.

C. Modification

C1. Modification 1

In the above-described embodiments, the appropriate melting depth ratio MDD and melting area ratio MSD with respect to the melting portion 5 formed between the grounding electrodes 20 and 20A and the metal shell 50 are described. Meanwhile, the definitions of the melting depth ratio MDD and the melting area ratio MSD in the melting portion 5 described in the above-described embodiments are not limited to the ignition plug 100 and the spark plug 100A of the above-described embodiments, and may be applied to the melting portion of the spark plug having the grounding electrode which is melt-joined to the inner wall surface of the tubular metal shell.

C2. Modification 2

The grounding electrode 20 of the first embodiment has an approximately disk shape including the through-hole 21 in the center. The grounding electrode 20A of the second embodiment includes three columnar connection portions 82 extending from the central annular portion 80 and the arc-shaped connection portion 83 connected to each columnar connection portion 82. Meanwhile, the grounding electrodes 20 and 20A are not limited to the configurations described in embodiments, and may include other configurations. For example, the grounding electrode 20 may not be a flat disk shape, and the center of the grounding electrode may be thickened. In addition, irregularities may be formed on the surface of the grounding electrode, and a portion of the outer circumferential end thereof may be notched. The grounding electrode 20A of the second embodiment may not be the configuration including three columnar connection portions 82. The grounding electrode 20A may be a configuration including one or two columnar connection portions 82, and may be a configuration including four or more columnar connection portions 82. In the grounding electrode 20A, the columnar connection portions 82 may not be arranged with equal intervals. In the grounding electrode 20A, the arc-shaped connection portion 83 is completely omitted, and each columnar connection portion 82 may be directly joined to the inner wall surface of the metal shell 50. In the grounding electrode 20A, the central annular portion 80 is omitted, and the tip portion of the columnar connection portion 82 opposes the tip surface or the side surface of the center electrode 10, and the spark gap may be formed. In this way, the configurations of the grounding electrodes 20 and 20A are not limited to the configurations described in each of the above-described embodiments. In addition, the configuration of the ignition portion, in which the spark gap is formed, also is not limited to the configuration described in each of the above-described embodiments.

C3. Modification 3

In the first embodiment, the melting portion 5 is formed over the entire outer circumference of the grounding electrode 20. Meanwhile, in the grounding electrode 20 of the first embodiment, like the second embodiment, the melting portion 5 may be formed on the regions which are distributed in plural on the outer circumference of the grounding electrode 20. The melting portion 5 may be formed on each of two regions different from each other, and may be formed on each of four or more regions different from one another. Preferably, the melting portion 5 is formed on the region of at least 30% or more on the entire circumference of the grounding electrode 20. In addition, preferably, the melting portion 5 is formed on the region of 60% or more on the entire circumference of the grounding electrode 20, and more preferably, is formed on the region of 90% or more.

The present invention is not limited to the embodiments, the examples, or the modifications described above including the configurations of the ignition portions or the like including the insulator, the center electrode, and the grounding electrode. The present invention is not limited to the embodiments, the examples, or the modifications described above, and various configurations can be realized within a scope which does not depart from the gist. For example, in order to solve a portion or the whole of the above-described objects or to achieve a portion or the whole of the above-described effects, it is possible to appropriately replace or combine the technical characteristics in the embodiments, the examples, or the modifications corresponding to the technical characteristics of each aspect described in the column of Summary of the Invention. Moreover, if the technical characteristics are not essential in the present specification, the technical characteristics are appropriately omitted.

DESCRIPTION OF REFERENCE NUMERALS AND SIGNS

5: melting portion
10: center electrode
11: tip portion
20: grounding electrode
21: through-hole
22: outer circumferential end surface
26: noble metal tip
26*c*: cylindrical hole
30: insulator
31: axial hole
32: reduced-diameter opening portion
32*s*: cavity
33: tip-side portion
35: stepped surface
36: flange portion
37: rear end-side portion
40: terminal electrode
41: rear end portion
45: resistor
46, 47: first and second glass seal material
50: metal shell
50*a*: shell tip-side portion
50*b*: shell rear end-side portion
51: cylindrical hole
52: cylindrical wall portion
52*d*: stepped surface
52*s*: screw portion
53: protrusion
54: crimping portion
55: tip-side opening end portion
55*s*: inner wall surface
56: tool engaging portion
57: thin portion
58: flange portion
60: cap portion
61: thin hole

70: talc layer
71, 72: wire packing
73: gasket
80: central annular portion
81: through-hole
82: columnar connection portion
83: arc-shaped connection portion
83*s*: outer circumferential arc surface
100: ignition plug
100A: spark plug
CX: central axis Having described the invention, the following is claimed:

1. A spark plug comprising:
a shaft-shaped center electrode;
a tubular insulator, which accommodates at least a rear end-side portion of the center electrode in an inner portion of the insulator;
a grounding electrode, which is disposed while having a gap between a tip portion of the center electrode and the grounding electrode; and
a tubular metal shell including a through-hole in which the insulator is accommodated,
wherein the grounding electrode is fixed to an inner wall surface of the through-hole of the metal shell,
wherein the grounding electrode is fixed to the metal shell via a melting portion in which the grounding electrode and the metal shell are melted to each other, and
wherein, in a cross section including a bottom portion of the melting portion, which is a rearmost end-side portion in the melting portion, and a central axis of the through-hole:
in the melting portion, a melting depth, which is a distance in a central axis direction of the through-hole between the bottom portion of the melting portion and a virtual straight line including an outline of a tip-side surface of the grounding electrode, is 5% or more of a thickness of the grounding electrode in the central axis direction; and
an area of a shell-side portion of the melting portion, which is positioned at an outer circumferential side of the metal shell from a virtual straight line connecting endpoints of the inner wall surface of the metal shell, is 10% or more of an entire area of the melting portion, the endpoints of the inner wall surface of the metal shell being positioned at a tip-side and a rear end-side of the melting portion in the central axis direction.

2. The spark plug according to claim 1,
wherein, in the cross section of the melting portion:
the melting depth is 15% or more of the thickness of the grounding electrode in the central axis direction; and
the area of the shell-side portion is 20% or more of the entire area of the melting portion.

3. The spark plug according to claim 2,
wherein, in the cross section of the melting portion, the melting depth is 25% or more of the thickness of the grounding electrode in the central axis direction.

4. The spark plug according to claim 3,
wherein, in the cross section of the melting portion, the melting depth is 40% or more of the thickness of the grounding electrode in the central axis direction.

5. The spark plug according to claim 3,
wherein, in the cross section of the melting portion, the area of the shell-side portion is 30% or more of the entire area of the melting portion.

6. The spark plug according to claim 1,
wherein the grounding electrode includes an outer circumferential end portion, which comes into contact with an entirety of an inner circumference of the inner wall surface in the through-hole of the metal shell, and
wherein the melting portion is formed on an entirety of an outer circumference side of the outer circumferential end portion.

7. The spark plug according to claim 1,
wherein the grounding electrode includes:
an arc shaped outer arc portion, which is positioned at an outer circumferential side and faces the inner wall surface of the through-hole;
an inner annular portion, which surrounds an outer circumference of the tip portion of the center electrode; and
a connection portion, which is provided between the outer arc portion and the inner annular portion and connects the outer arc portion and the inner annular portion,
wherein the melting portion is formed at least between a portion of the outer arc portion to which the connection portion is connected, and a wall portion of the metal shell.

8. The spark plug according to claim 7,
wherein the connection portion includes a plurality of columnar connection portions radially extending toward the outer arc portion from the inner annular portion, and
wherein the melting portion is formed to correspond to at least each of the plurality of columnar connection portions.

9. A spark plug comprising:
a shaft-shaped center electrode;
a tubular insulator, which accommodates at least a rear end-side portion of the center electrode in an inner portion of the insulator;
a grounding electrode, which is disposed while having a gap between a tip portion of the center electrode and the grounding electrode; and
a tubular metal shell including a through-hole in which the insulator is accommodated,
wherein the grounding electrode is fixed to an inner wall surface of the through-hole of the metal shell,
wherein the grounding electrode is fixed to the metal shell via a melting portion in which the grounding electrode and the metal shell are melted to each other, and
wherein, in a cross section including a bottom portion of the melting portion, which is a rearmost end-side portion in the melting portion, and a central axis of the through-hole:
in the melting portion, a melting depth, which is a distance in a central axis direction of the through-hole between the bottom portion of the melting portion and a virtual straight line including an outline of a tip-side surface of the grounding electrode, is 5% or more of a thickness of the grounding electrode in the central axis direction; and
an area of a shell-side portion of the melting portion, which is positioned at an outer circumferential side of the metal shell from a virtual straight line connecting endpoints of the inner wall surface of the metal shell, is 10% or more of an entire area of the melting portion, the endpoints of the inner wall surface of the metal shell being positioned at a tip-side and a rear end-side of the melting portion in the central axis direction,
wherein the grounding electrode includes:
an arc shaped outer arc portion, which is positioned at an outer circumferential side and faces the inner wall surface of the through-hole;

an inner annular portion, which surrounds an outer circumference of the tip portion of the center electrode; and a connection portion, which is provided between the outer arc portion and the inner annular portion and connects the outer arc portion and the inner annular portion, and wherein the melting portion is formed at least between a portion of the outer arc portion to which the connection portion is connected, and a wall portion of the metal shell.

10. The spark plug according to claim 9, wherein the connection portion includes a plurality of columnar connection portions radially extending toward the outer arc portion from the inner annular portion, and wherein the melting portion is formed to correspond to at least each of the plurality of columnar connection portions.

11. A spark plug comprising:

a shaft-shaped center electrode;

a tubular insulator having an inner portion in which at least a rear end-side portion of the center electrode is positioned;

a grounding electrode positioned such that a gap exists between a tip portion of the center electrode and the grounding electrode; and a tubular metal shell including a through-hole in which the insulator is positioned, wherein the grounding electrode is fused to an inner wall surface of the through-hole of the metal shell via a fused portion, and wherein, in a cross section defined by a bottom portion of the fused portion, which is the rearmost end-side portion in the fused portion, and a central axis of the through-hole:

in the fused portion, a fused depth which is a distance in a central axis direction of the through-hole between the bottom portion of the fused portion and a virtual straight line including an outline of a tip-side surface of the grounding electrode, is 5% or more of a thickness of the grounding electrode in the central axis direction; and an area of a shell-side portion of the fused portion, which is positioned at an outer circumferential side of the metal shell from a virtual straight line connecting endpoints of the inner wall surface of the metal shell, is 10% or more of an entire area of the fused portion, the endpoints of the inner wall surface of the metal shell being positioned at a tip-side and a rear end-side of the fused portion in the central axis direction.

12. The spark plug according to claim 11, wherein the grounding electrode includes:

an arc shaped outer arc portion, which is positioned at an outer circumferential side and faces the inner wall surface of the through-hole;

an inner annular portion, which surrounds an outer circumference of the tip portion of the center electrode; and a connection portion, which is provided between the outer arc portion and the inner annular portion and connects the outer arc portion and the inner annular portion, wherein the fused portion is formed at least between a portion of the outer arc portion to which the connection portion is connected, and a wall portion of the metal shell.

13. The spark plug according to claim 12, wherein the connection portion includes a plurality of columnar connection portions radially extending toward the outer arc portion from the inner annular portion, and wherein the fused portion is formed to correspond to at least each of the plurality of columnar connection portions.

* * * * *